US008523338B2

(12) United States Patent
Kambe

(10) Patent No.: US 8,523,338 B2
(45) Date of Patent: Sep. 3, 2013

(54) INK CARTRIDGE

(75) Inventor: Hiroaki Kambe, Chiba (JP)

(73) Assignee: Seiko Instruments Inc. (JP)

( * ) Notice: Subject to any disclaimer, the term of this patent is extended or adjusted under 35 U.S.C. 154(b) by 273 days.

(21) Appl. No.: 12/454,252

(22) Filed: May 14, 2009

(65) Prior Publication Data

US 2009/0284573 A1 Nov. 19, 2009

(30) Foreign Application Priority Data

May 15, 2008 (JP) ..... 2008-128249

(51) Int. Cl.
*B41J 2/175* (2006.01)

(52) U.S. Cl.
USPC ..... 347/86

(58) Field of Classification Search
None
See application file for complete search history.

(56) References Cited

U.S. PATENT DOCUMENTS 5,666,146 A * 9/1997 Mochizuki et al. ..... 347/86
6,053,606 A * 4/2000 Yamaguchi et al. ..... 347/86
6,609,789 B1 * 8/2003 Hunt ..... 347/86

FOREIGN PATENT DOCUMENTS

JP 2006 21397 1/2006

OTHER PUBLICATIONS

Machine translation of JP2006-021397 Junichiro.*

* cited by examiner

*Primary Examiner* — Matthew Luu
*Assistant Examiner* — Renee I Wilson
(74) *Attorney, Agent, or Firm* — Adams & Wilks

(57) ABSTRACT

An ink cartridge has a case in which is disposed a flexible ink bag containing ink. The ink bag has two opposed major surfaces, one of which is fixed to the case. Two regulation members are adhered to the other major surface and are spaced apart in the lengthwise direction of the ink bag to define therebetween a deformable region which extends the full width of the ink bag and along which the ink bag deforms as the ink is consumed and the ink bag contracts. An ink end detection plate is adhered to the other major surface, adjacent one of the regulation members, and undergoes movement with the ink bag as it contracts to provide an indication of when the ink is nearly used up.

14 Claims, 4 Drawing Sheets

INK CARTRIDGE

BACKGROUND OF THE INVENTION

The present invention relates to an ink cartridge that supplies ink to an inkjet printer.

In order to cope with requirements for mass printing, width enlargement, and speed increase, an inkjet printer provides an ink supply source independent of an inkjet head, adopts a system of supplying ink from the ink supply source through a tube, and uses an ink bag as the ink supply source in some case.

As an example of the inkjet printer constructed as described above, a construction is mentioned, in which the ink bag is received in a hard case to constitute an ink cartridge, an ink supply port provided on one end of the ink bag is connected to the tube, and the ink is introduced into the inkjet head through the tube, whereby the ink is supplied to the inkjet head. Further, a construction is also possible, in which a sub tank is provided between the ink cartridge and the inkjet head, whereby the supply of the ink to the inkjet head is not stopped immediately after the ink in the ink bag runs out.

When such an ink supply mode is constructed, a selectable range of a received position of the ink cartridge in the inkjet printer is increased, and in addition, an increase of a capacity of the ink cartridge, which meets the requirements for the inkjet printer to achieve the mass printing, the width enlargement, and the speed increase, also becomes easy. As a result, enlargement of the ink bag in terms of size and dimension is adopted.

Incidentally, as seen in Japanese Patent No. 3494014, as such an ink-cartridge, there is one that includes a reinforcement film in a peripheral portion of an ink supply port of a deformable ink bag, and prevents breakage of the ink bag even if the ink bag is enlarged in terms of size and dimension in response to the increase of the capacity of the ink cartridge.

In the case of using a hermetically sealed ink bag, the ink bag contracts in a process in which the ink is consumed. At this time, the ink bag cannot be sometimes deformed in accordance with a shape of an ink bag attaching portion of the hard case. Further, initial distortion of the ink bag owing to flexure and wrinkle of the ink bag, which are caused at the time when the ink bag of the ink cartridge is attached to the hard case, comes to largely affect the deformation of the ink bag. As a result, extreme deformation of only a part of the ink bag occurs, the distortion of the ink bag is promoted together with consumption of the ink, resulting in the deformation of the ink. Further, it becomes sometimes impossible to stably and sufficiently supply the ink in the ink bag to the inkjet head. Because of those problems, such a problem occurs that the ink in the ink bag cannot be fully used though a large amount thereof remains in the ink bag. Those problems have become prone to occur owing to the enlargement of the ink bag in terms of size and dimension, which follows the increase of the capacity of the ink cartridge.

SUMMARY OF THE INVENTION

To address the above-mentioned problems, it is an object of the present invention to provide an ink cartridge capable of sufficiently using the ink in the ink bag by controlling the deformation of the ink bag even if the ink bag is distorted owing to the enlargement of the ink bag in terms of size and dimension, and to the flexure and wrinkle of the ink bag, which are caused at the time when the ink bag is attached to the hard case of the ink cartridge.

In order to achieve the above-mentioned object, the present invention is an ink cartridge including an ink bag that has flexibility and is provided with an ink supply port on one end thereof, and including regulation members which are provided on a surface of the ink bag and control a deformable position of the ink bag in a consumption process of ink.

The regulation members of the present invention are provided on the ink bag so as to control the deformation, which follows the consumption of the ink, of the ink bag, and the ink bag is deformed at a predetermined position, whereby the distortion of the ink bag and abnormal deformation of the ink bag may be prevented from occurring. It is an object of the present invention to provide an ink cartridge including the ink bag having such effects as described above.

DETAILED DESCRIPTION OF THE PREFERRED EMBODIMENTS

Figure 1:
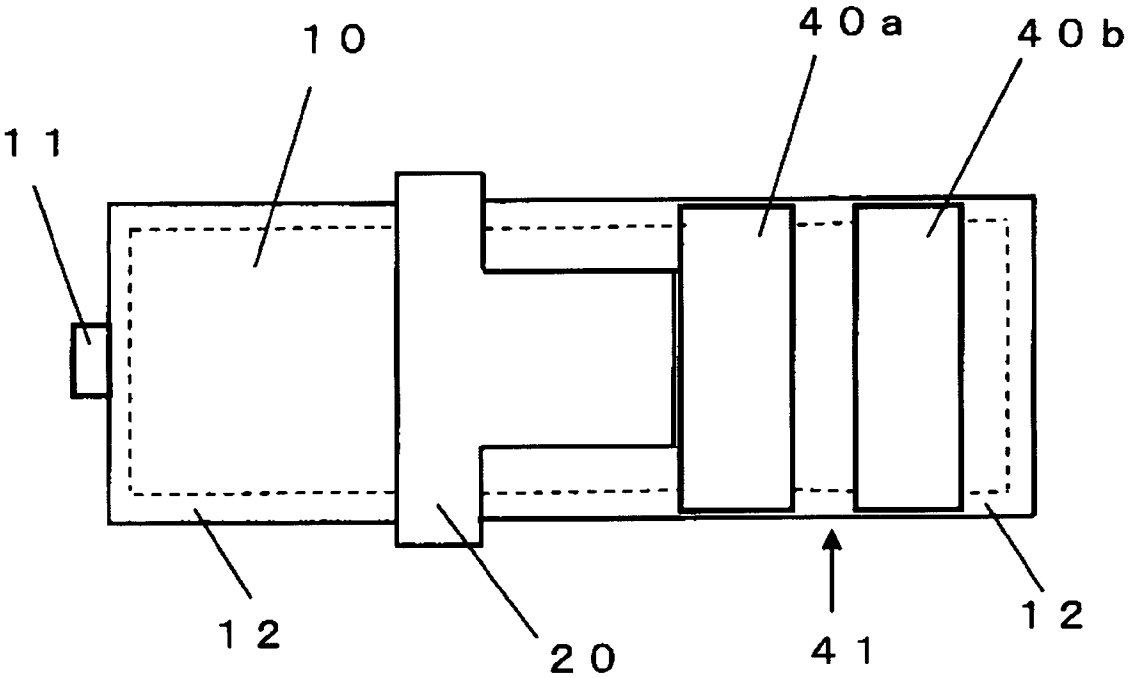
FIG. 1 is a top view illustrating an ink bag and regulation members.

Next, a description is made of an embodiment of the present invention. In an ink cartridge, an ink bag is received in a case while enabling ink to be supplied to an outside of the case. The ink bag is provided with an ink supply port on one end thereof, and has flexibility. Regulation members which control a deformable position of the ink bag in a consumption process of the ink are arranged on a surface of the ink bag. Before the ink bag is started to be used in an inkjet printer, a cross-sectional shape of the ink bag in a lateral direction thereof is such a shape that is formed by facing substantial semicircles to each other, and the regulation members are arranged on the surface of the ink bag in a state of being deformed in accordance with the cross-sectional shape thereof. It is required that the regulation members have rigidity of an extent not to damage the flexibility of the ink bag. In the case where the ink bag involves a small curvature radius on the above-mentioned cross-sectional shape, it is necessary to reduce the rigidity of the regulation members. Note that, besides selecting a material of the regulation members, adjustment of the rigidity of the regulation members is also realizable by selecting a thickness of the material, selecting a material and thickness of each of materials forming each of the regulation members in the case where each regulation member is formed into a stack structure, and adjusting a size and width of the regulation members.

In order to ensure strength, ink resistance, and gas barrier properties, the ink bag is formed of at least one type of a resin film, which is among polyethylene, polypropylene, polyethylene terephthalate, nylon, polyvinyl chloride, polyvinylidene chloride, polyvinyl alcohol, and a copolymer of ethylene vinyl alcohol. In the case of ensuring more robust gas barrier properties, it is recommended that foil of metal such as aluminum or a film evaporated with metal such as aluminum be provided as an intermediary layer of the ink bag.

As the material of the regulation members, it is possible to select elastic film members in the form of a metal thin plate, a rubber sheet, a sheet using a foamed material of resin or rubber, and the like as well as the resin film or thin plate. In addition, in the case of using a double sided adhesive tape as a method of fixing the regulation members to the ink bag, consideration should be made so that a thermal expansion coefficient of the regulation members can become substantially equal to a thermal expansion coefficient of the material of the ink bag, and such characteristics that the regulation members are not peeled off even if the environmental temperature is changed are required for the double sided adhesive tape. For example, if such a material as a polyethylene terephthalate sheet is used for the regulation members, then the thermal expansion coefficient substantially equal to that of the ink bag is obtained by the polyethylene terephthalate sheet, and accordingly, the regulation members are not peeled off even if the double sided adhesive tape is used for fixing the regulation members.

The regulation members have a function to allow the ink bag to be deformed into an intended shape following consumption of the ink, and arrangement of the regulation members is decided by assuming the intended shape made by the deformation.

For example, in the case where the ink cartridge is formed of a hard case that is formed of a case body and a lid and receives the ink bag, and the ink cartridge has an inclined portion on another end with respect to an end on which the ink supply port provided on the ink bag attached to the case body is provided, the inclined portion becomes a hand hitch at the time of pulling out the ink cartridge from the ink jet printer on the outside of the hard case. Meanwhile, in the inside of the hard case, the inclined portion sometimes has a function of an attaching surface of the one end of the ink bag. By this inclined portion of the case body, the ink bag is gradually deformed following the consumption of the ink, and finally, must be deformed in accordance with an irregular (recessed and protruding) shape of the case body. In this case, preferably, the ink bag is bent on a recessed portion between a planar portion of the case body and the inclined portion thereof, and is brought into intimate contact with such a case body.

The regulation members are located on the surface of the ink bag, and rigidities of the respective spots of the ink bag are changed depending on whether or not the regulation members are in contact therewith. Hence, in such a deformation process of the ink bag, which follows the consumption of the ink, portions of the ink bag, which have the regulation members, are less likely to be deformed, and portions of the ink bag, which do not have the regulation members, are likely to be deformed, whereby it becomes possible to selectively arrange the deformed portions of the ink bag. When the regulation member is disposed singly, the end portion of the regulation member sometimes becomes a position where the ink bag is deformable. However, it cannot always be determined that the deformation occurs from the end portion. Meanwhile, when a plurality of the regulation members are arranged in line, a low-rigidity portion of the ink bag can be disposed on purpose between the regulation members, and accordingly, the position where the ink bag is deformable can be restricted to a narrower range.

Hence, for example, in the case where, in the case body to which the ink bag attached, planar portions different in angle exist on the portions of the case body held in contact with the ink bag, the position where the ink bag is deformable is disposed on a tangential line of those two planes, whereby the deformation of the ink bag, which follows the consumption of the ink, can be obtained in accordance with the shape of the case body.

However, in the vicinity of the ink supply port of the ink bag, the ink bag has a three-dimensional shape, and the deformation process of the ink bag, which follows the consumption of the ink, also involves three-dimensional deformation. Accordingly, in comparison with other portions of the ink bag, to the vicinity of the ink supply port of the ink bag, a larger load is likely to be applied. In order to prevent an excessive load from being applied to the ink bag, desirably, the regulation members are not arranged in the vicinity of the ink supply port of the ink bag.

Further, in general, the case body has an irregular (recessed and protruding) shape in the longitudinal direction of the ink bag. Accordingly, also in arranging the regulation members, a position where the ink bag is deformable in the longitudinal direction thereof just needs to be considered. Meanwhile, frequently, a shape of the case body in a lateral direction of the ink bag is a planar shape. Desirably, the ink bag that finishes supplying the ink turns to the planer shape in the above-mentioned direction. Therefore, it is not necessary to provide the position where the ink bag is deformable. Hence, the regulation members are arranged so as to continue from one end portion in the lateral direction of the ink bag to the other end portion therein, whereby the deformation of the ink bag in the lateral direction thereof can be prevented. Note that, in this case, a length of the regulation members may be set longer than that of the ink bag in the lateral direction of the ink bag.

Further, in an ink bag on which an ink end detection plate is provided in order to detect a residual amount of the ink, the regulation members are located adjacent to the ink end detection plate, whereby such an effect is sometimes obtained that the rigidity of the regulation members extends the ink end detection plate in a pseudo manner. When the ink is consumed and the ink bag is deformed, the regulation members adjacent to the ink end detection plate operate substantially integrally therewith, whereby the above-mentioned effect is obtained. However, effectiveness of the above-mentioned effect is inferior to that in the construction in which the ink end detection plate is simply extended, and the effect of the regulation members is merely auxiliary.

FIG. 1 illustrates an embodiment of an ink bag to which the present invention is applied. An ink bag 10 is a flat bag having opposed major surfaces and is formed of a flexible material for hermetically sealing the ink. The ink bag 10 is a hermetically sealed container. The ink bag 10 swells when the ink is filled thereinto, and contracts in matching with a decrease of the ink when the decrease occurs. At one end of the ink bag 10, an ink supply port 11 is formed integrally therewith by a method such as thermal welding. The ink supply port 11 has a function to discharge the ink in the ink bag 10, and is formed of a resin molded article.

An ink end detection plate 20 is attached to a one ma or surface of the ink bag 10. The ink end detection plate 20 detects that the ink in the ink bag 10 falls down below a predetermined amount by using a detection mechanism (not shown). In other words, the ink end detection plate 20 detects an ink end, i.e., when the ink in the ink bag 10 is nearly used up. The ink bag 10 contracts in response to the decrease of the ink in the ink bag 10 in terms of capacity, and in matching with this decrease, the ink end detection plate 20 also moves. It is sensed that the ink in the ink bag 10 is decreased, and that the ink end detection plate 20 reaches a predetermined position, whereby "empty" of the ink cartridge is detected. Preferably, the ink end detection plate 20 is intimately adhered to one surface of the ink bag 10 by using a double sided adhesive tape or an adhesive.

The ink bag 10 is one formed into a flat bag shape by thermally welding peripheral portions of two multilayer resin films to each other. Specifically, the ink bag 10 is one formed into a small bag shape in which a thickness is small with respect to a width and a length. A welded portion 12 is welded on the periphery of the ink bag 10 with a width enough to ensure sufficient strength so as to avoid ink leakage. Further, the ink bag 10 may be made of a multilayer resin film including an aluminum film.

On major surface of the ink bag 10 on an opposite end to the ink supply port 11 while sandwiching the ink end detection plate 20 therebetween, two regulation members 40*a* and 40*b* are provided. The regulation member 40*a* is located so as to be adjacent to the ink end detection plate 20, and the regulation member 40*b* is disposed more on the outside than the regulation member 40*a* so as to be spaced a little from the regulation member 40*a*. Such an interval between the regulation member 40*b* and the regulation member 40*a* becomes a deformable position 41, i.e., a deformable region of the ink bag 10 which deforms as the ink bag contracts. Specifically, when the ink is consumed, the ink bag 10 gradually contracts, and is bent along the deformable region between the regulation member 40*a* and the regulation member 40*b*. The reason for this is as follows. Specifically, the regulation member 40*a* or the regulation member 40*b* has higher rigidity than the deformable position 41, and accordingly, a portion of the deformable position 41 having smaller rigidity is deformed. Note that, with regard to both of the regulation members 40*a* and 40*b*, a length thereof in the lateral direction of the ink bag 10 is substantially equal to a length of the ink bag 10 in the above-mentioned direction. In such a way, the deformable position 41 can be bent substantially along the regulation members between both end portions of the ink bag 10 in the lateral direction of the ink bag 10. Further, preferably, the regulation members 40*a* and 40*b* are extended to positions which cover the welded portion 12 on both ends of the ink bag 10 in the lateral direction thereof. The reason for this is as follows. Specifically, because the welded portion 12 has higher rigidity than portions which are not welded, unexpected deformation is prone to occur an a portion in which there is a difference in rigidity, and accordingly, it is necessary to control the deformation by the regulation members.

Figure 2:
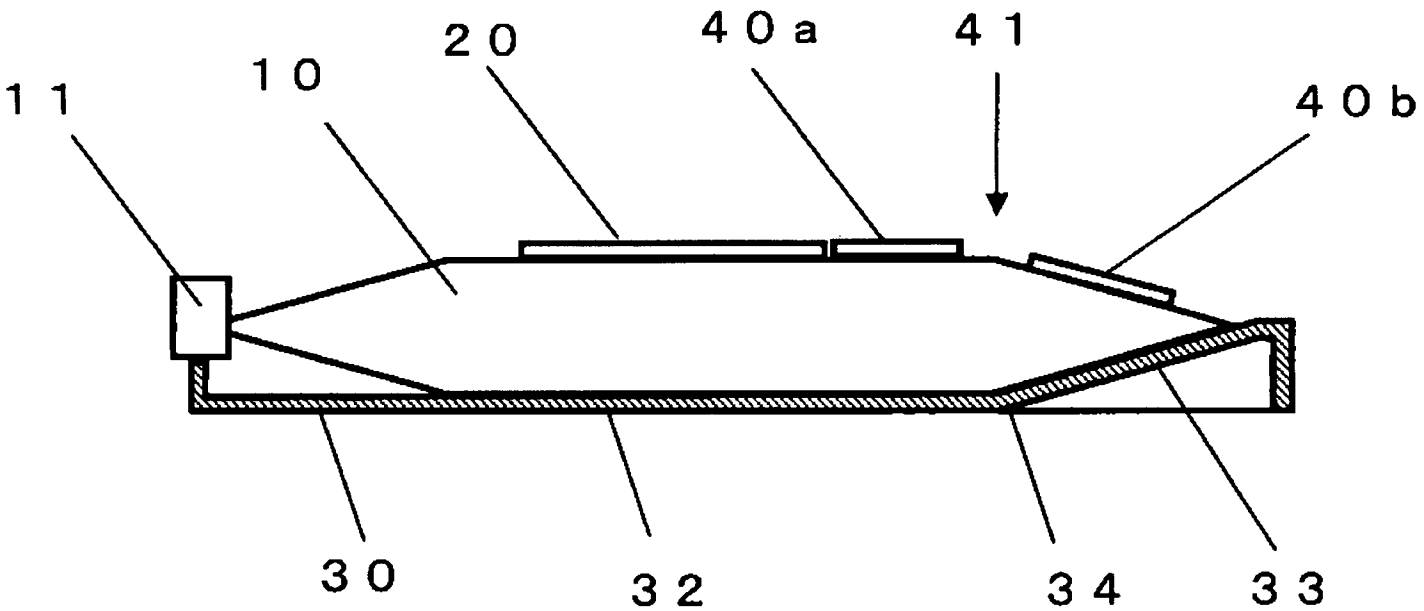
FIG. 2 is a cross-sectional view of an ink cartridge.

FIG. 2 is an assembly example when the ink bag 10 illustrated in FIG. 1 is incorporated into the hard case of the ink cartridge. With regard to the ink bag 10, the other major surface thereof is adhered onto a case body 30 of the hard case by a double sided adhesive tape (not shown) or the like. The ink bag 10 is fixed to the case body 30 in matching with a shape of the case body 30 from the ink supply port 11 side through a planar portion 32 and a recessed portion 34 over an inclined portion 33. The planar portion 32 and the inclined portion 33 join together at a bent portion of the case body 30, the bent portion being aligned with the deformable position 41 of the ink bag 10. At this time, onto the one ma or surface of the ink bag 10, the ink end detection plate 20, the regulation member 40*a*, and the regulation member 40*b* are attached in order from the ink supply port 11 side, and the deformable position 41 located between the regulation member 40*a* and the regulation member 40*b* is positioned immediately above the recessed portion 34 of the case body 30. With regard to the inclined portion 33, the case is dented so as to allow the finger of a user to enter a portion of the inclined portion 33, which corresponds to a handle of the ink cartridge. Though not shown, a lid that fits to the case body 30 is provided, and the ink bag 10 is covered with the case body 30 and the lid.

Figure 3:
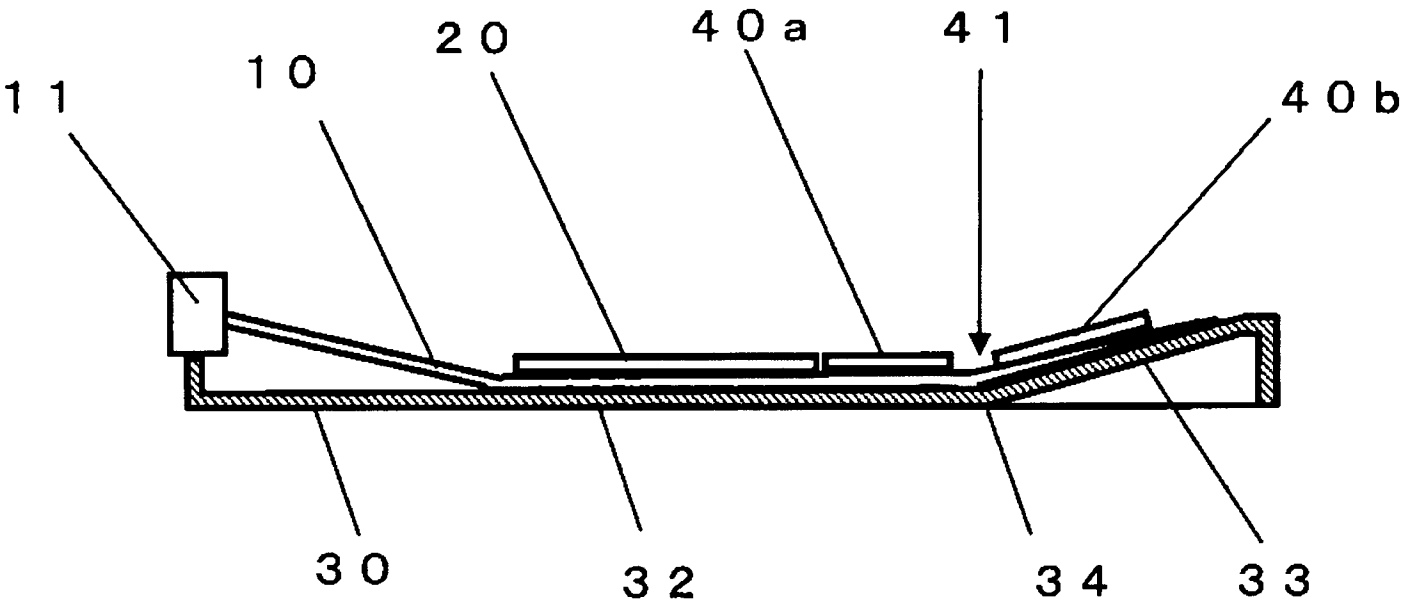
FIG. 3 is a cross-sectional view of the ink cartridge when ink is consumed.

FIG. 3 is a cross-sectional view when the ink in the ink bag 10 illustrated in FIG. 1 is consumed. The ink bag 10 is bent at the deformable position 41 between the regulation member 40*a* and the regulation member 40*b*. Further, the deformable position 41 is a position corresponding to the recessed portion 34 between the planar portion 32 of the case body 30 and the inclined portion 33 thereof. At this portion, the bag 10 is prone to be deformed abnormally, and when the ink bag is wrinkled to a large extent, such a problem occurs that an erroneous operation of the ink end detection plate 20 is caused. Therefore, in order to deform the ink bag 10 in matching with the shape of the case body 30, the regulation members 40*a* and 40*b* are arranged so as to sandwich the position corresponding to the recessed portion 34 when the ink is consumed.

The description has been made of the embodiment on the premise that the number of each of the regulation members 40*a* and 40*b* is one. However, a plurality of the regulation members may be arranged in the lateral direction of the ink bag 10. In this case, the ink bag 10 is deformed along edge side portions of the plurality of regulation members. Further, in some case, the ink cartridge is used while being erected so that the lateral direction of the ink bag 10 can be parallel to the gravity direction. Here, when a description is made on the premise that the gravity direction is a downward direction, the ink is accumulated in the ink bag 10 in the downward direction, force applied to the ink bag 10 is changed between the downward direction and an upward direction. In this case, regulation members different in thickness between the downward direction and the upward direction of the ink bag 10, that is, regulation members different in rigidity therebetween can also be used.

Figure 4:
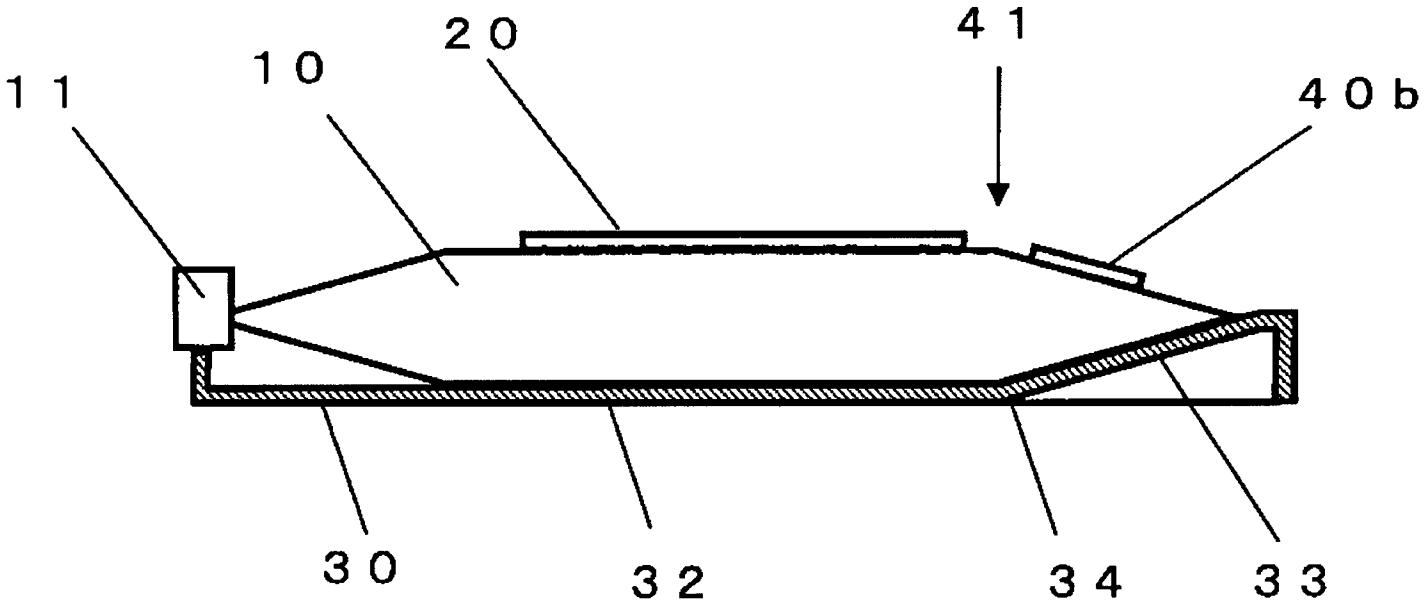
FIG. 4 is a cross-sectional view of an ink cartridge, illustrating a second embodiment.

FIG. 4 is another embodiment. The ink end detection plate 20 is formed into a shape extended to the vicinity of the recessed portion 34, and is made to also serve as a substitution of the regulation member, and the regulation member 40*b* is provided on the opposite side to the ink end detection plate while sandwiching the deformable position 41 therebetween. The number of members caused to adhere onto the ink bag 10 is reduced, and accordingly, a manufacturing process can be simplified. Further, because the ink end detection plate 20 is a plate having higher rigidity than the regulation member 40*b*, the ink bag 10 can be deformed along an edge of the ink end detection plate 20.

What is claimed is:

1. An ink cartridge, comprising:

a flat ink bag that has flexibility and has an ink supply port on one end thereof, the ink bag comprising two resin films welded together along opposed side edge portions thereof;

an ink end detection plate adhered to the ink bag so that the ink end detection plate moves in accordance with a change of capacity of ink in the ink bag;

a case that receives the ink bag while fixing one flat surface of the ink bag thereto so that ink can be supplied to outside from the ink supply port, the case having a recessed portion between a planar portion of the case and an inclined portion of the case; and regulation members which control deformation of the ink bag so that another flat surface of the ink bag can be deformed at a deformable position opposite the recessed portion of the case when the ink is consumed from the ink bag and the ink bag contracts, the regulation members comprising elastic film members adhered to the another surface at positions sandwiching the deformable position therebetween on the another surface of the ink bag, the regulation members extending to positions which cover the welded side edge portions of the ink bag in a lateral direction of the ink bag and being adhered the full width of the ink bag in the lateral direction thereof, one of the elastic film members being opposed to the planar portion of the case and another of the elastic film members being opposed to the inclined portion of the case.

2. The ink cartridge according to claim 1, wherein the deformable position is disposed in matching alignment with a bent portion of the case to which the ink bag is attached.

3. The ink cartridge according to claim 2, wherein the regulation members are located on a substantially peripheral portion of the ink bag.

4. The ink cartridge according to claim 1, wherein a thermal expansion coefficient of the regulation members is substantially equal to a thermal expansion coefficient of the ink bag.

5. The ink cartridge according to claim 2, wherein at least one of the regulation members is arranged adjacent to the ink end detection plate.

6. An ink cartridge, comprising:

a case;

a flexible ink bag containing ink disposed in the case, the ink bag having a generally flat shape with two opposed major surfaces each having a length and a width, the two major surfaces being welded together at side edge portions thereof along the length of the ink bag, one of the two major surfaces being fixed to the case, and an ink supply port for supplying the ink to outside the ink cartridge; and two regulation members adhered to the other of the two major surfaces and spaced apart in the lengthwise direction of the ink bag to define therebetween a deformable region of the ink bag which extends substantially the full width of the ink bag and along which the ink bag deforms when the ink is consumed and the ink bag contracts, the two regulation members extending widthwise the full width of the ink bag to cover the welded side edge portions.

7. An ink cartridge according to claim 6; wherein the regulation members comprise resin films.

8. An ink cartridge according to claim 6; wherein the regulation members comprise sheet members.

9. An ink cartridge according to claim 6; wherein the case has a planar portion and an inclined portion connected to a lengthwise end of the planar portion, the one major surface of the ink bag being fixed to the planar and inclined portions, and the deformable region of the ink bag being opposed to the case at a location where the planar portion connects to the inclined portion.

10. An ink cartridge according to claim 9; wherein the case has a recessed portion defined, in part, by the inclined portion to enable the ink cartridge to be manually gripped for attachment to and detachment from the printer.

11. An ink cartridge according to claim 6; further including an ink end detection member adhered to the other major surface of the ink bag to undergo movement in accordance with contraction of the ink bag as the ink is consumed.

12. An ink cartridge according to claim 11; wherein the ink end detection member is positioned adjacent to one of the regulation members.

13. An ink cartridge according to claim 6; wherein one of the regulation members constitutes an ink end detection member that undergoes movement in accordance with contraction of the ink bag as the ink is consumed.

14. An ink cartridge according to claim 6; wherein a thermal expansion coefficient of the regulation members is substantially equal to a thermal expansion coefficient of the ink bag.

* * * * *